United States Patent [19]

Peterson

[11] 4,237,672

[45] Dec. 9, 1980

[54] ROOFING VENT AND INSTALLATION TOOL

[75] Inventor: Lloyd A. Peterson, Center City, Minn.

[73] Assignee: Lloyd Plastics Company, Forest Lake, Minn.

[21] Appl. No.: 28,520

[22] Filed: Apr. 9, 1979

Related U.S. Application Data

[63] Continuation of Ser. No. 873,792, Jan. 31, 1978, abandoned.

[51] Int. Cl.[3] ..... F04B 1/74; F24F 7/02

[52] U.S. Cl. ..... 52/743; 52/92; 52/95; 52/199; 98/37; 98/DIG. 6

[58] Field of Search ..... 52/90, 92, 95, 198, 52/199, 743, 99; 98/32, 37, 42, DIG. 6

[56] References Cited

U.S. PATENT DOCUMENTS

| | | | |
|---|---|---|---|
| 365,426 | 6/1887 | Barnes et al. | 294/19 R |
| 688,044 | 12/1901 | Williamson | 294/24 |
| 2,477,152 | 7/1949 | Stevenson | 52/199 X |
| 3,683,785 | 8/1972 | Grange | 52/92 X |
| 3,863,553 | 2/1975 | Koontz | 52/95 X |
| 4,096,790 | 6/1978 | Curran | 98/42 R X |
| 4,125,971 | 11/1978 | Ward | 52/199 X |

FOREIGN PATENT DOCUMENTS

| | | | |
|---|---|---|---|
| 2315793 | 10/1974 | Fed. Rep. of Germany | 52/407 |

*Primary Examiner*—Alfred C. Perham

*Attorney, Agent, or Firm*—Orrin M. Haugen; Thomas J. Nikolai

[57] ABSTRACT

A roofing vent adapted to be installed in the attic space of a building so as to communicate between a soffit zone and the attic space to improve the circulation of air therein and a special tool to facilitate the installation thereof. The roofing vent comprises an open-ended channel having a generally U-shaped cross-section and a plurality of transversely extending notches integrally formed in the bottom surface of the channel at spaced apart locations. The installation tool comprises an elongated handle having a vent gripping working surface at one end thereof. Also located proximate to this working surface is a roller member having its axis of rotation generally parallel to and a predetermined distance above the vent engaging surface. The length of the handle is such that an operator may stand in a location where the pitch of the roof permits sufficient head room for convenient working. By manipulating the tool, the roofing vent may be located proximate the intersection of the roof rafters with the ceiling joists.

1 Claim, 4 Drawing Figures

ROOFING VENT AND INSTALLATION TOOL

This is a continuation of application Ser. No. 873,792 filed Jan. 31, 1978, now abandoned.

BACKGROUND OF THE INVENTION

I. Field of the Invention

This invention relates generally to apparatus for increasing air circulation within the attic space of a building having a pitched roof and more specifically to the design of a roofing vent which is adapted to extend between a soffit zone and an attic space which does not become blocked during the laying of insulation bats or the blowing of loose insulation material into the attic space, as well as to the design of a tool for facilitating the installation of such a roofing vent from a more convenient location within the attic space.

II. Description of the Prior Art

It is well known in the home building industry that proper circulation of air within an attic zone and above the level at which the insulation is installed is essential to avoid moisture build-up during cold winter months and to maintain the uninsulated attic space at a reasonably low temperature during warm summer months. It is common practice to provide ventilating holes in the soffit members which extend horizontally between the lower edge of the roof line and the exterior walls of the building. It is also common practice to provide layers of insulation between the ceiling joists and, in fact, in a well insulated building, the level of insulation often extends above the top level of the ceiling joists. Unless care is exercised during the installation of the insulation layers, the insulation may block the desired path between the soffit zone and the uninsulated attic space. This insulation barrier inhibits the needed circulation of fresh air within the attic space.

In accordance with the teachings of the present invention, there is provided a roofing vent which is adapted to extend between the soffit zone and the uninsulated attic space, the vent ensuring that insulation build-up will not inadvertently block the air circulation path which is intended to be provided by the ventilating holes formed in the horizontally extending soffit members.

In its preferred form, the roofing vent of the present invention comprises a generally U-shaped channel having a bottom surface and opposed side walls extending perpendicularly thereto for a predetermined distance. This channel member is open-ended and the perpendicularly extending side walls are adapted to abut the plywood sheeting normally nailed to the upper edge of the roof rafters. When so installed, then, air entering the soffit zone passes through the channel into the attic space.

Because the vent of the present invention must be positioned proximate the intersection of the roof rafters with the ceiling joists, with a normal pitch to the roof, very little head clearance is available at the point of installation. Thus, for ease of installation, it is desirable that a tool be provided which will permit the operator to position himself somewhat remote from the point at which the vent is to be installed so that the normal pitch of the roof will provide ample head room. The installation tool of the present invention provides this desired arrangement. More specifically, the roof vent of the preferred embodiment includes a plurality of integrally formed, spaced apart grooves or indentations which extend outwardly from the bottom surface of the U-shaped channel. The installation tool, itself, comprises an elongated handle on one end of which is disposed a transversely extending block member having a width dimension which is less than the spacing between the perpendicularly extending side walls of the roof vent. This block member has a wedge shaped working surface on the underside thereof which is adapted to engage the grooves formed in the channel. Disposed on the upper edge of the block member, i.e., on the edge which is opposite to the wedge shaped surface, there is provided a roller means having its axis of rotation disposed generally parallel to the longitudinal axis of the block member. When in use, this roller member is adapted to cooperate with the undersurface of the plywood sheeting which is nailed to the outer edge of the roof rafters. Because a roller member is provided, it is found that during use, the tool can ride over any roofing or shingle nails which may extends through the plywood sheeting.

OBJECTS

It is accordingly the principal object of the present invention to provide a new design for a roofing vent and an installation tool for facilitating the insertion of the vent between a soffit zone and an attic space in a building having a pitched roof.

Another object of the invention is to provide a new design for a roofing vent which is adapted to extend between and permit air flow from a soffit zone into an attic zone and which may be installed from a point remote from the location where the vent is to ultimately reside.

Still another object of the invention is to provide a tool, especially designed to facilitate the installation of the novel roofing vent.

These and other objects and advantages of the invention will become apparent to those skilled in the art from the following detailed description of the preferred embodiment when taken in connection with the accompanying drawings in which:

DESCRIPTION OF THE PREFERRED EMBODIMENT

Figure 1:
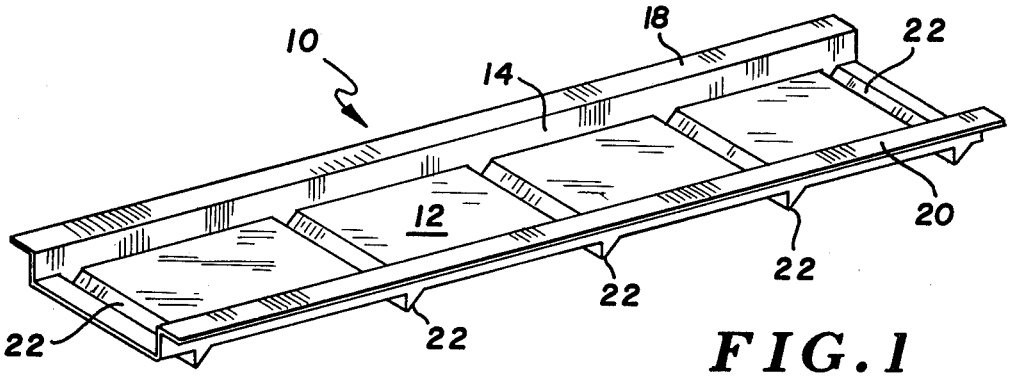
FIG. 1 is a perspective view of the roofing vent of the present invention.

Referring now to FIG. 1, there is indicated generally by numeral 10 the roofing vent comprising the preferred embodiment of the invention. As is illustrated, the vent 10 is generally U-shaped in cross-section, having a bottom surface 12 and integrally formed, generally perpendicularly extending side walls 14 and 16. The vent 10 is open-ended at both ends and thus resembles a chute or channel. While not absolutely required, it may be desirable to include generally laterally extending flanges 18 and 20 along the length of the side walls 14 and 16 as illustrated.

Figure 2:
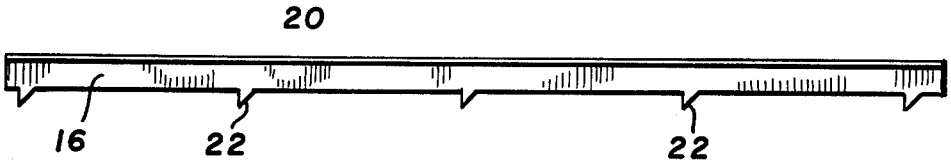
FIG. 2 is a side elevation of the roofing vent of FIG. 1.

As can also be observed from FIG. 1, there is formed in the bottom surface 12 of the U-shaped channel or chute 10 a plurality of laterally extending grooves or indentations 22 which project outwardly from the undersurface of the bottom 12 as, perhaps, can best be seen in the side view of FIG. 2.

Figure 3:
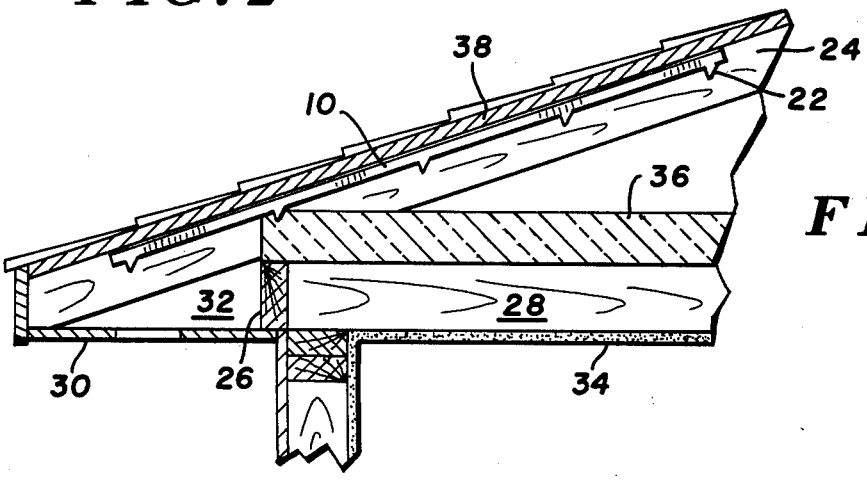
FIG. 3 is a partial, cross-sectional view of a typical roof structure with which the present invention finds utility.

The manner of use of the roofing vent of this invention can best be discerned by reference to FIG. 3 of the drawings. In FIG. 3, there is shown a partial cross-sectional view of a typical roof construction. Numeral 24 identifies a roof rafter which is supported proximate its outer end by a transversely extending plate member 26. A ceiling joist, indicated by numeral 28 is shown as being attached at one end thereof to the plate 26. It is to be noted that the roof rafter 24 extends downward beyond the outer edge of the plate 26 for a predetermined distance and that a soffit member 30 extends in a generally horizontal plane from the outermost end of the roof rafter 24 back to the exterior wall of the building. This soffit member is provided with a plurality of openings (not shown) which permits air to pass through the openings and into the soffit zone indicated by numeral 32. Numeral 34 indicates a slab of sheet rock which is nailed to the underside of the ceiling joist 28 and which forms the ceiling surface of the room beneath the attic space.

In order to provide an insulating barrier between the living space of the building and the attic space, it is common practice to install a suitable insulating material identified by numeral 36 between the ceiling joists 28. For proper insulation, in some areas of the country, it is recommended that the insulation be of a depth of six to twelve inches. The insulation layer 36 may be either in the form of fiberglass battings or may be loose material which is blown into the attic space either during construction or thereafter.

To prevent moisture condensation problems during cold weather and to prevent excessive heat build-up in the attic space during warm weather, it is essential that air be free to circulate from the soffit zone 32 into the attic space between the insulation layer 36 and the plywood sheeting 38 which is nailed to the outer edges of the roof rafters 24. Unless due care is exercised during the installation of the insulation material, it is possible that the insulation layer 36 will rise to a level where it forms an effective barrier between the soffit zone and the attic zone. The roofing vent 10 of the present invention is utilized to ensure that air will be free to circulate between these two zones.

With continued reference to FIG. 3, it can be seen that the roofing vent member 10 of the present invention is installed proximate to the intersection of the roof rafters 24 with the ceiling joists 28 i.e. proximate the building's plateline. A predetermined portion of the elongated channel-shaped vent 10 extends into the soffit zone 32 proximate the underside of the sheeting layer 38. The other end of the roofing vent 10 extends into the uninsulated attic zone. Because the channel member is open-ended, air is free to flow through the channel or chute from the soffit zone to the attic zone and vice versa. In new construction, it may be desirable to nail or staple the channel member 10 in its desired orientation. As such, it is possible to drive suitable fasteners through the flanges 18 and 20 and into the sheeting material 38. In older construction, during the installation of additional insulation, there is no need to attach the roofing vent 10 to the underside of the plywood sheeting 38 in that the roofing vent may be easily installed by merely guiding the vent member 10 along the exposed undersurface of the plywood sheeting 38 until it becomes wedged between the insulating layer 36 and the sheet 38.

Figure 4:
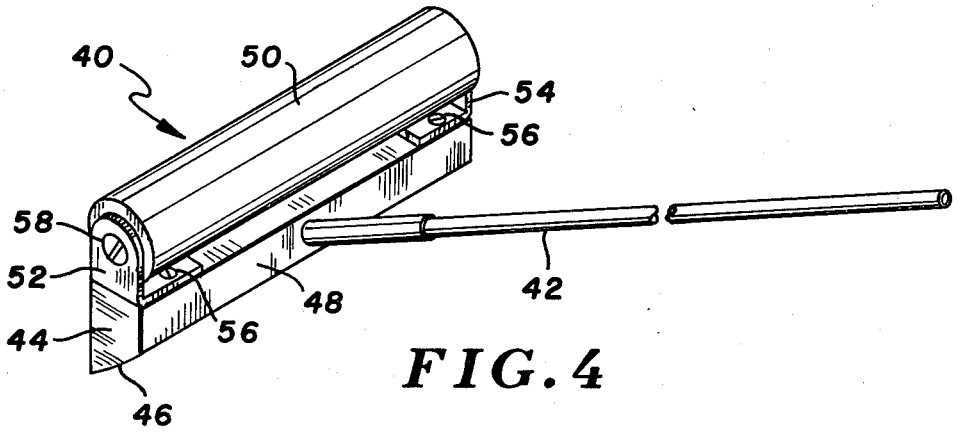
FIG. 4 is a perspective view of the novel installation tool of the present invention.

Because of the close quarters and lack of head room for the installer at the point in the building proximate the soffit zone, it has been found useful to utilize the installation tool illustrated in FIG. 4. With reference to FIG. 4, it can be seen that the installation tool, which is indicated generally by numeral 40 comprises as elongated handle 42 which may be fabricated from bamboo, aluminum tubing or other suitable material. Attached to the distal end thereof is a block member 44 having a working surface on the lower edge 46 which is generally wedge-shaped. The block 44 may be formed from wood, plastic or other suitable material. Affixed to the opposed edge surface 48 of the block member 44 are roller means including a right circular cylindrical roller member 50 having its longitudinal axis disposed generally parallel to the width dimension of the block 44. First and second right angle brackets 52 and 54 are attached to the edge surface 48 of the block 44 as by screws 56. Screws 58 are provided which pass through an oversized aperture in the bracket 52 and which threadedly engage the roller member 50 along its central axis.

The width dimension of the block 44 and its associated roller assembly 50 is slightly less than the width of the vent member 10. The length of the handle 42 may be in the order of eight to twelve feet such that the person installing the roof vent through the use of the tool of FIG. 4 may position himself at a point in the attic space remote from the intersection of the roof rafters 24 with the ceiling joist 28 at a point where he may conveniently assume a standing position. Gripping the handle at its proximal end with one hand and using the other hand to support an end of the vent chute 10, the installer locates the leading edge of the wedge-shaped working surface 46 of the tool into one of the notches or indentations 22 formed in the chute. By pushing forward on the tool handle while simultaneously pulling back on the chute, the tool and chute may be lifted together as a unit. The operator allows the roller member 50 to ride upon the plywood sheeting 38 as he advances the chute 10 towards the soffit zone. By providing a roller on the working head of the tool, the tool readily passes over any roofing or shingle nails which may have their pointed ends exposed through the plywood sheeting layer 38. Once the tray or chute 10 is properly positioned with its leading edge well into the soffit zone and its trailing end in the uninsulated attic zone, the operator draws back on the handle of the tool and the working edge disengages from the notch 22 in the tray and can be withdrawn.

The roofing vent or chute 10 is preferably formed from high impact polystyrene plastic of a thickness which allows the tray to be bent during installation but which will resume its normal configuration when the bending force is removed. While the dimensions of the chute 10 are not overly critical, it has been found that an arrangement having an overall length of approximately four feet and a width of from eight to twelve inches and a height dimension of one to three inches is altogether suitable.

While in the above, one practical embodiment of the invention has been disclosed in detail, it will be understood that many changes may be made from the precise structure shown and described within the scope of the invention as defined by the appended claims.

What is claimed is:

1. In the construction of a pitched roof building of the type in which spaced apart roof rafters having roof sheathing attached to the outer side edge thereof intersect at an acute angle with horizontal ceiling joists along a plateline separating a soffit zone from the attic space, a method for maintaining adequate ventilation between said soffit zone and said attic zone, comprising the steps of:

(a) installing ceiling insulation material between said ceiling joists, said insulating material extending proximate the intersection of said roof rafters with the building's plateline; and (b) thereafter, from a position remote from the location of said plateline, inserting a plurality of elongated, open ended, molded plastic channel members between selected pairs of adjacent roof rafters of said pitched roof building with the bottom portion of said channel members being spaced from said roof sheathing by the side walls of said channel members, the bottom portion being provided with a plurality of transversely extending wedge-shaped notches, one open end of each of said channel members being disposed in said soffit zone and the other open end of said channel members being disposed in said uninsulated attic zone, said elongated open ended channel members being put in place with a long handled tool having a wedge-shaped head thereon for engaging a selected one of said wedge-shaped notches in said bottom portion of said channel members.

* * * * *